United States Patent [19]

Schumacher et al.

[11] 4,003,106

[45] Jan. 18, 1977

[54] LADDER STRAP CABLE TIE WITH PIVOTAL DOG

[75] Inventors: Charles G. Schumacher, Tinley Park; Robert E. Dravec, Palos Heights, both of Ill.

[73] Assignee: Panduit Corporation, Tinley Park, Ill.

[22] Filed: June 19, 1975

[21] Appl. No.: 588,273

[52] U.S. Cl. ..... 24/16 PB

[51] Int. Cl.[2] ..... B65D 63/00

[58] Field of Search ..... 24/73 PB, 206 A, 30.5 P, 24/230 B, 17 AP, 16 PB; 248/74 PB

[56] References Cited

UNITED STATES PATENTS

| | | | |
|---|---|---|---|
| 2,936,980 | 5/1960 | Rapata | 248/74 PB |
| 2,977,145 | 3/1961 | Rifkin | 248/74 PB UX |
| 3,106,028 | 10/1963 | Baumgartner | 24/16 PB X |
| 3,735,448 | 5/1973 | Waddington | 24/16 PB |
| 3,766,608 | 10/1973 | Fay | 24/16 PB |
| 3,872,547 | 3/1975 | Caveney et al. | 24/16 PB |

*Primary Examiner*—Donald A. Griffin
*Attorney, Agent, or Firm*—Charles R. Wentzel; Richard B. Wakely

[57] ABSTRACT

A self-locking cable tie for forming a plurality of elongate objects into a bundle. The cable tie comprises an elongate strap including a pair of spaced longitudinally extending side rails joined by a plurality of spaced transverse rungs; and a head extending from adjacent one end of the strap and including a strap entry face, a strap exit face and a strap-receiving aperture extending between the faces. The cable tie further comprises a locking dog including a flexible neck pivotally joining the dog to the head. The dog is formed of a material having greater strength in compressive loading than in shear loading per unit cross-sectional area. Furthermore, the dog extends into the aperture and toward the strap exit face. The dog is sequentially engageable with the rungs and is resiliently biased to extend between adjacent rungs of the strap. The dog further includes a free end portion comprising positioning means for holding the rung to be held. The cable tie further comprises limiting means for limiting pivotal movement of the dog towards the strap entry face after application of strap withdrawal force, so that the major component of the force is directed through the dog from the free end portion to the neck whereby after application of strap withdrawal force, the dog securely holds the strap and the dog is predominantly in columnar loading.

12 Claims, 15 Drawing Figures

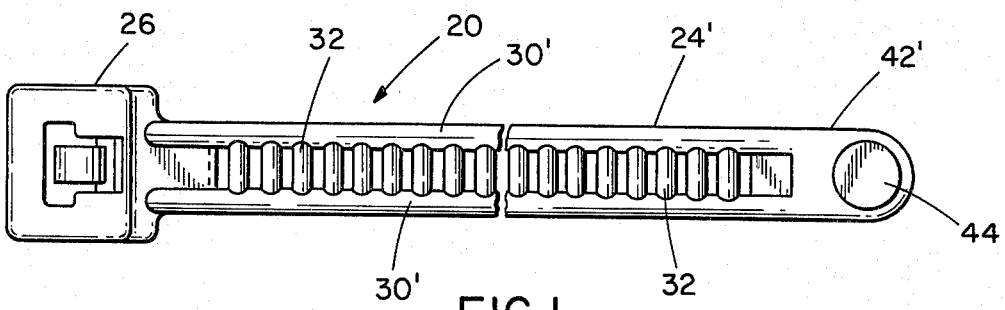
FIG.1
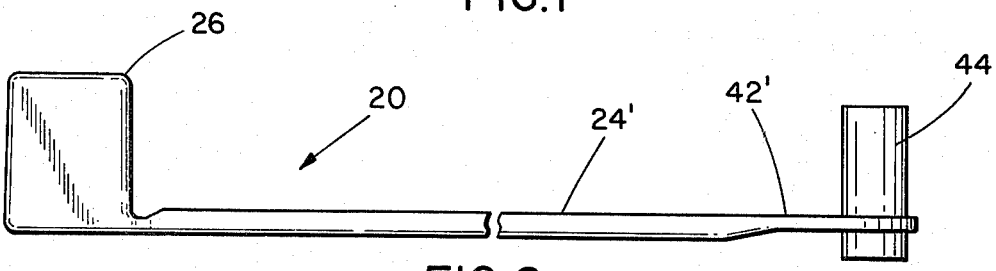
FIG.2
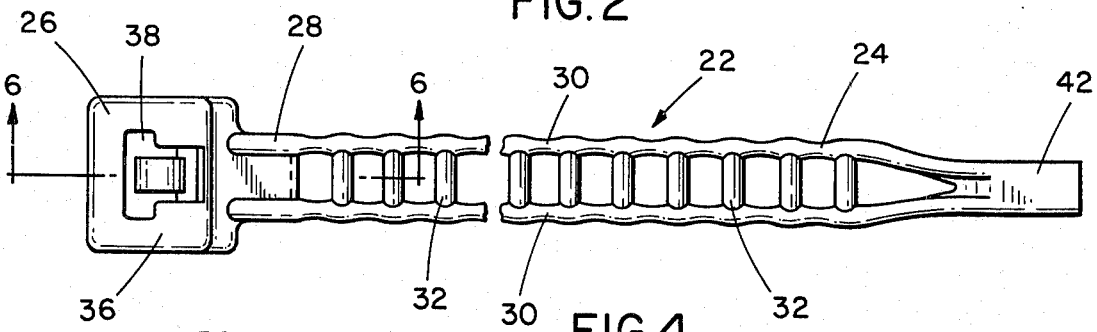
FIG.4
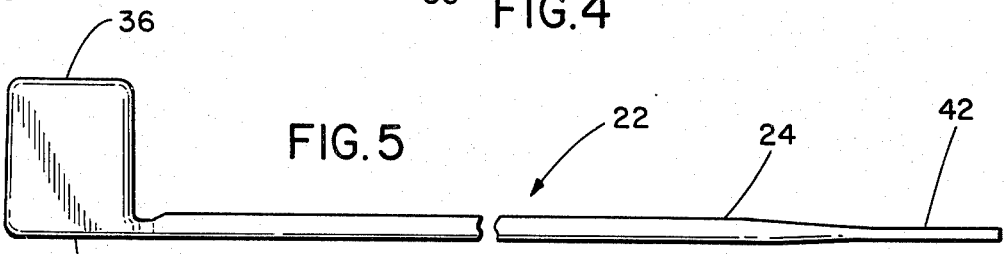
FIG.5
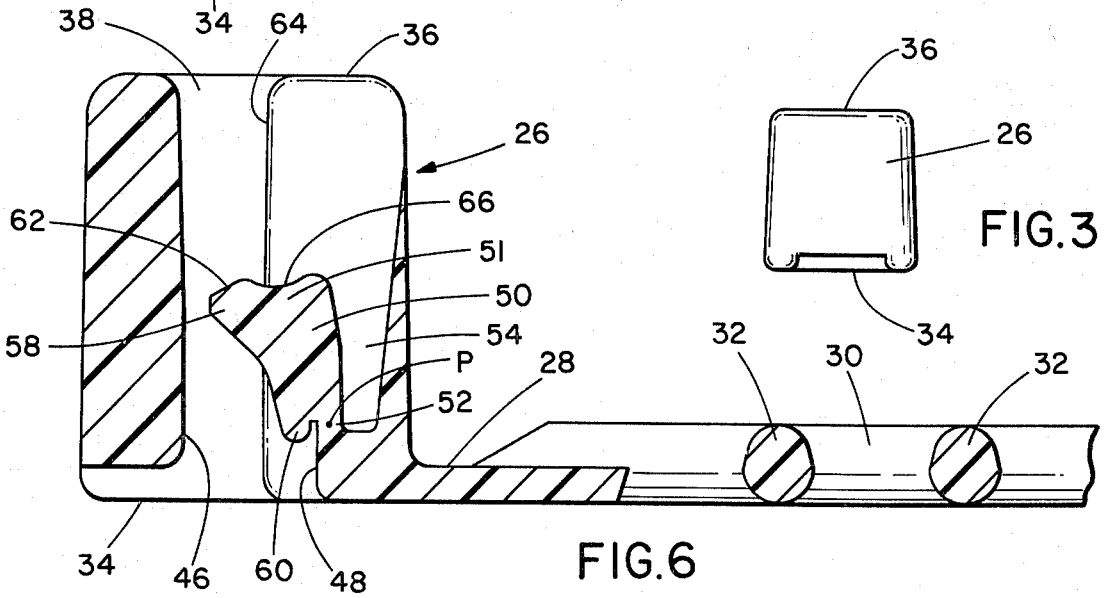
FIG.6
FIG.3

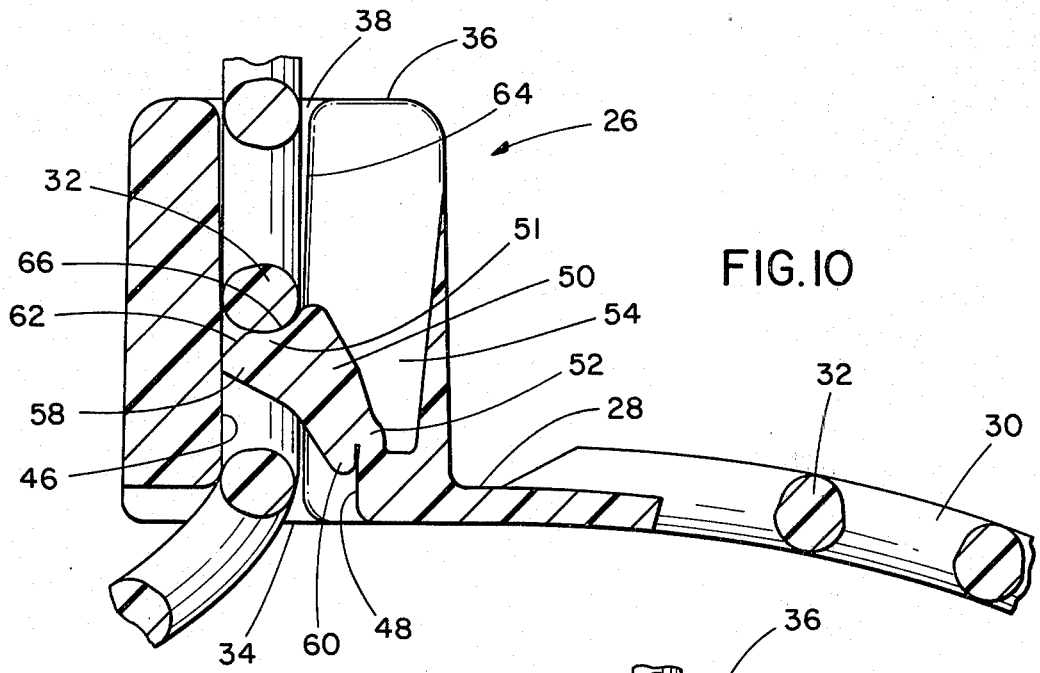
FIG. 10
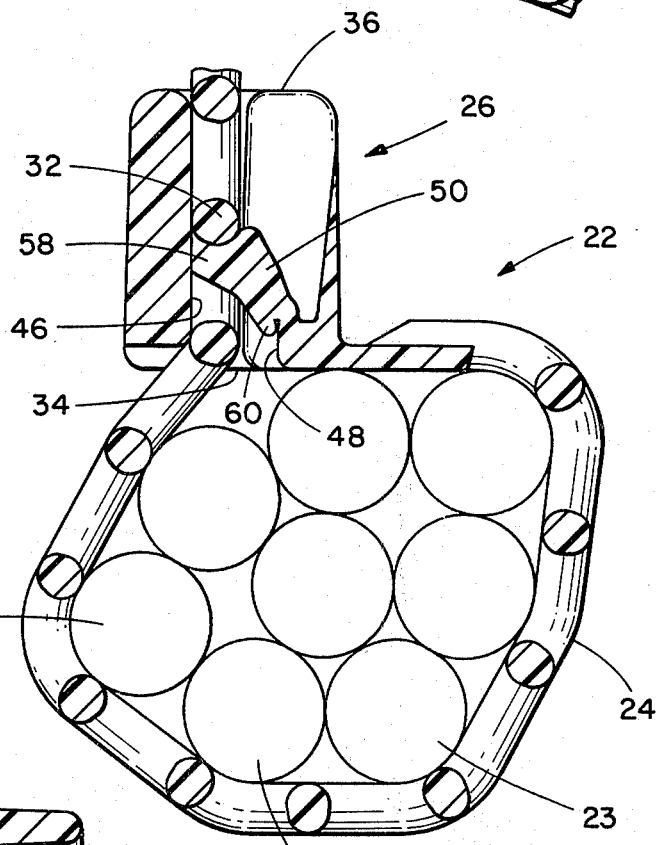
FIG. 11
FIG. 12
PRIOR ART
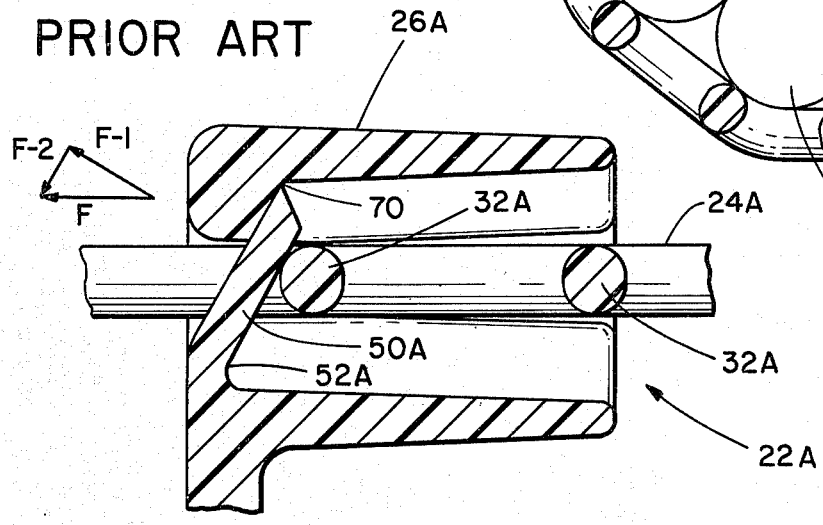

LADDER STRAP CABLE TIE WITH PIVOTAL DOG

BACKGROUND OF THE INVENTION

The present invention relates to self-locking cable ties and more particularly to such a cable tie having a ladder strap and a pivotal dog for securely locking the strap.

Cable ties of molded thermoplastic material for conveniently forming elongate objects such as wires into a bundle have come into common use in the last 20 years. More recently, cable ties having stretched straps of reduced cross-sectional area have appeared. Since longitudinal stretching of the plastic strap to orient the molecules in the direction of the stretch causes an increase in tensile strength, such stretched straps are at least as strong as non-stretched straps which have a greater cross-sectional area. Examples of prior art molded ties are shown in U.S. Pat. Nos. 3,186,047 and 3,660,869.

Prior art self-locking cable ties typically include locking means pivotally carried by the head of the cable tie. Such locking means could either be integral with the head, such as a toothed plastic pawl or dog for engaging and meshing with teeth on the strap, or non-integral with the head, for example, a metallic barb for biting into the strap. The integral locking means has an advantage in that it can be provided at the time of the molding and, accordingly, the number of operations required to manufacture the cable tie is reduced. Stretching the strap not only causes it to increase in tensile strength per unit cross-section area but also causes the thermoplastic material to significantly harden thereby making it difficult for prior art integral locking means to effectively engage a hardened stretched strap.

To overcome this disadvantage of integral locking means, a ladder type stretched strap having longitudinally extending side rails joined by spaced transverse rungs has been proposed. It should be noted that a ladder strap, whether molded to its final dimensions or stretched, uses less material in fabrication and, accordingly, is lighter than a comparable strap of a uniform cross section or having teeth disposed on one side of the strap. The locking means typically used with such a ladder strap is a long finger pivotally joined to the head by a neck and engageable upon attempted strap withdrawal with a fixed ledge on the head opposite the neck. With such an arrangement, the finger is loaded as a beam with strap withdrawal forces distributed between the ledge and neck and, accordingly, the neck must be sufficiently thick to resist shear and excessive bending. Of course, as neck thickness increases, higher forces are required to deflect the finger out of the strap pass path during threading of the strap. An example of such a cable tie is shown in U.S. Pat. No. 3,766,608.

Straps of stretched thermoplastic material which are not self-locking have been proposed for bundling packages or a plurality of objects and for attaching tags and buttons to clothing. They typically require separate crimp connectors for application to an overlapping portion of the strap. Reference may be made to U.S. Pat. Nos. 3,444,597 and 3,447,207.

SUMMARY OF THE INVENTION

Among the several objects of the present invention may be noted the provision of an improved self-locking cable tie; the provision of such a cable tie which has high tensile strength with a reduction in material used in fabrication and which, accordingly, is lighter in weight; the provision of such a cable tie which is convenient in use and which provides relatively low force threading of the strap into the head by placing the locking means in columnar loading and which thereby avoids the requirement of a relatively thick locking means neck as is needed to withstand shear when the locking means is loaded as a beam; and the provision of such a cable tie which is reliable in use, has long service life, and is simple and economical to manufacture. Other objects and advantageous features of the present invention will be in part pointed out hereinafter in the specification and in the claims annexed thereto, and in part will be apparent.

Briefly, the self-locking cable tie of the present invention comprises an elongate strap, a head extending from adjacent one end of the strap, a locking dog including a flexible neck pivotally joining the dog to the head, and means for limiting pivotal movement of the dog towards the strap entry face. The strap includes a pair of spaced longitudinally extending side rails joined by a plurality of spaced transverse rungs. The head includes a strap entry face, a strap exit face, and a strap-receiving aperture extending between the faces. The locking dog is formed of a material having greater strength in compressive loading than in shear loading per unit cross-sectional area. The dog extends into the aperture and toward the strap exit face, and is sequentially engageable with the rungs and biased to extend between adjacent rungs. The dog has a free end portion including positioning means for holding the rung to be held. The limiting means directs the major component of strap withdrawal force through the dog from the free end portion to the neck whereby after application of strap withdrawal force, the dog securely holds the strap and the dog is predominantly in columnar loading.

BRIEF DESCRIPTION OF THE DRAWINGS

FIG. 1 is a plan of a molded part before stretching and cutting to form a cable tie of the present invention having a ladder-type strap;

FIG. 2 is a front elevational view of the part of FIG. 1;

FIG. 3 is a side elevational view of a head of the part of FIG. 1;

FIG. 4 is a plan of the cable tie formed from the part of FIG. 1 after stretching and cutting to form the strap;

FIG. 5 is a front elevational view of the cable tie of FIG. 4;

FIG. 6 is an enlarged sectional view taken generally along line 6—6 of FIG. 4 and showing details of the head;

FIG. 10, also similar to FIG. 7, illustrates the locking dog engaging a pair of facing abutment surfaces of the head when large withdrawal forces are applied to the strap;

FIG. 11 is a sectional view of the cable tie of the present invention positioned around a plurality of wires;

FIG. 12 is a cross-sectional view of a prior art locking head showing the locking dog under load;

Corresponding reference characters indicate corresponding parts throughout the several views of the drawings.

DESCRIPTION OF THE PREFERRED EMBODIMENT

Figure 7:
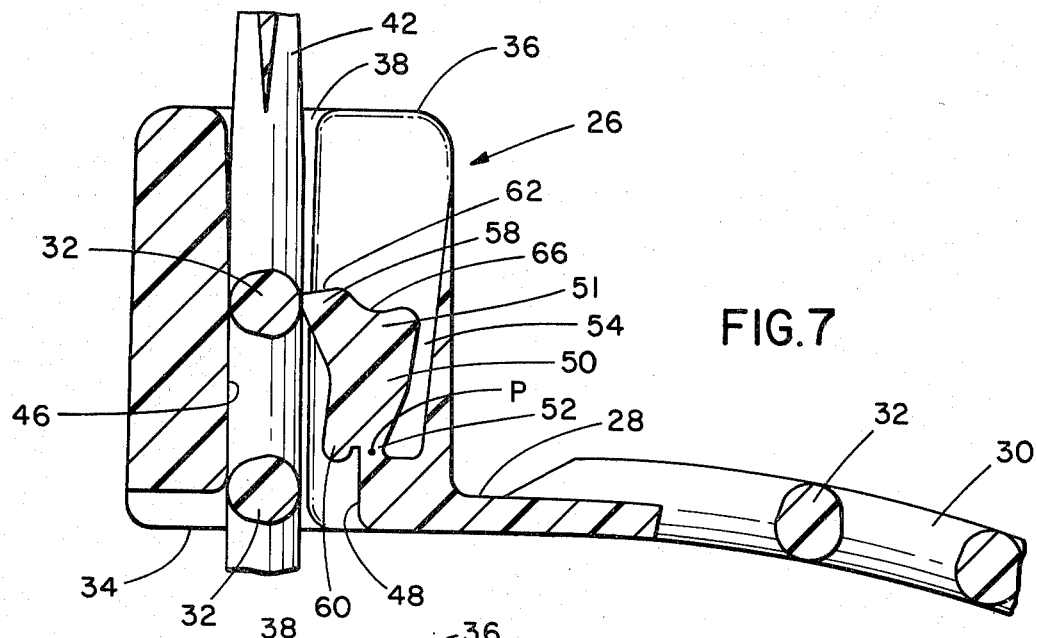
FIG. 7 is similar to FIG. 6 and shows a locking dog of the cable tie being deflected upon threading of the strap into the head.

Referring to FIGS. 1 and 2, an as-molded part is generally indicated at reference numeral 20. As will appear hereinafter, part 20 is stretched and cut to form a self-locking high strength cable tie 22, fully shown in FIGS. 4, 5, and 11, of the present invention for forming a plurality of objects such as wires 23, see FIG. 11, into a bundle which usually is of a generally circular cross section. Components of part 20 corresponding to components of cable tie 22 except for substantial stretching and/or cutting are designated by a prime (′).

Cable tie 22 is integral and comprises an elongate flexible strap 24 made of a thermoplastic material, such as nylon, comprising stretch-oriented molecules; a head 26 extending from adjacent one end of the strap; and a transitional portion 28 joining the head and the strap. Strap 24 is positionable about the objects to be bundled and includes a plurality of spaced, transversely extending abutments. More particularly, strap 24 is of the ladder type and has a pair of spaced, generally longitudinally extending side rails or supports 30 with the abutments constituting rungs or crosspieces 32 joining the rails. Head 26 includes a strap entrance face 34, a strap exit face 36, and a transverse aperture 38 joining the faces.

Part 20 includes an elongate tail 42′ extending from strap 24 with a pulling lug 44 extending in opposite directions from the tail. Tail 42 is preferably tapered to facilitate insertion of the strap into aperture 38.

Although as-molded nylon parts have relatively unoriented molecules, stretching of the part causes orientation of the molecules in the direction of the stretch with the result that after stretching, although reduced in cross-sectional area, the part has higher tensile strength and breaking strength per unit cross-sectional area than the unstretched part. Stretching also causes hardening of the material.

Part 20 is longitudinally stretched between lug 44 and head 26 until the material in side rails 30 has its molecular structure oriented. Since those components of strap 24 having smaller cross sections will stretch before components having greater cross sections, the stretching can be controlled and substantially limited to the portions of side rails 30 between the rungs. The portions of the side rails adjacent the rungs are slightly stretched and give the side rails an undulating appearance as shown in FIG. 4. By way of example, part 20 can be stretched at a temperature of 200° F and at a rate of 50 inches per minute for an overall strap elongation of 75%. As set forth above, the stretching is controlled so that the rungs are not significantly stretched. Side rails 30 between rungs elongate approximately 250%.

It should be noted that basic engineering building materials such as steel or nylon generally can bear greater loads per unit cross section when in compression loading than in shear loading. Thus, it is desirable to load a part formed of such material as a column rather than a beam. For example, Zytel (a trademark of E. I. Du Pont de Nemours & Co.) 101 nylon at 73° F and 0.2% moisture content has a tensile strength of approximately 12,000 psi and a shear strength of approximately 9,600 psi. For such a material, the yield stress in tension. Reference may be made to pages stress in tension. Reference may be maade made pages 14–20 of the *Zytel Nylon Resins Design Handbook*, copyright 1972 by E. I. Du Pont de Nemours & Co., Wilmington, Del. 19898.

Figure 8:
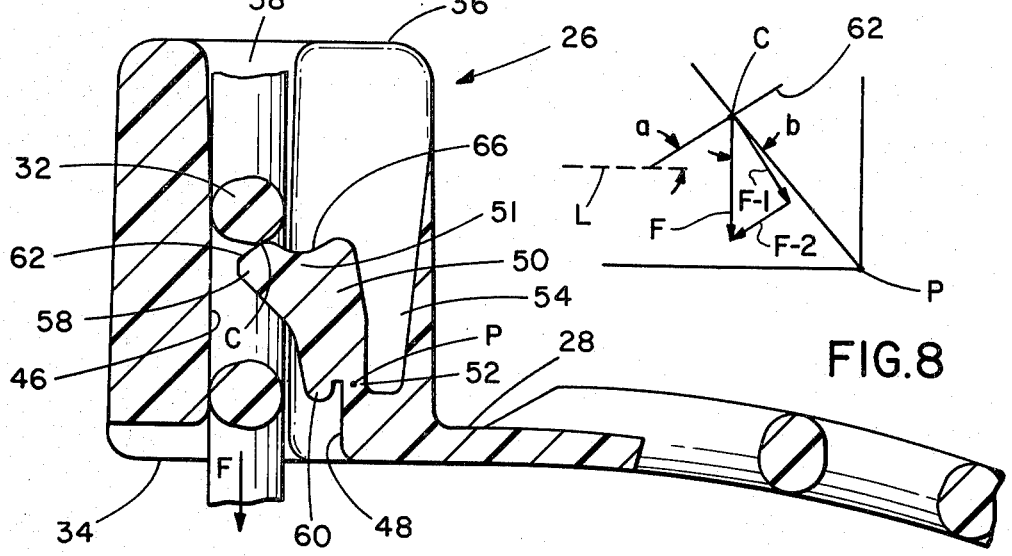
FIG. 8, similar to FIG. 7, shows a rung of the strap to be held engaging the dog upon initial application of strap withdrawal forces.

Referring to FIGS. 6, 7, 8, 9, and 10, head 26 includes a pair of facing, transversely extending generally planar abutment surfaces 46, 48 which partially define aperture 38; and further includes a pivotal locking dog 50 extending into aperture 38 and toward strap exit face 36 from adjacent abutment surface 48. Locking dog 50 is preferably generally elongate having a free end portion 51 and is joined to head 26 by a relatively thin flexible neck 52 which functions to resiliently bias the locking dog 50 to extend between adjacent rungs 32 of the strap as shown in FIG. 8. Head 26 further comprises a slot 54 adjoining aperture 38 and extending from dog 50 toward strap exit face 36 to permit the dog to deflect and pivot about a point in the neck 52 generally indicated by reference letter P upon threading of strap 24 into the strap-receiving aperture as shown in FIG. 7. Of course the terms "pivotal" and "pivot point" are to be accorded their broad meanings. That is, the term "pivotal", when used in the context of a one-piece nylon cable tie is intended to include some flexing of the neck and dog in addition to pure rotation of the dog about an imaginary hinge. Additionally, it is to be understood that the term "pivot point" is used merely to identify the general area of the neck which is likely to undergo the greatest flexure. This general area may deviate slightly from that identified due to high strap withdrawal force, abnormal temperature, etc.

Locking dog 50 comprises a first abutment means or finger 58 shaped to extend between adjacent rungs 32 and engageable with abutment surface 46 and further includes a second abutment means or nose 60 which is, as will appear hereinafter, engageable with abutment surface 48 when the strap 24 is under large withdrawal forces. Finger 58 is engageable with surface 46 between pivot point P and strap exit face 36 while nose 60 extends adjacent surface 48 toward strap entry face 34. As will appear hereinafter, abutment surfaces 46 and 48, finger 58, and nose 60 constitute limiting means for limiting pivotal movement of dog 50 towards strap entry face 34 after application of strap withdrawal force so that a major component of the force is directed longitudinally through the dog from free end portion 51 to neck 52. That is, the limiting means serves to restrain movement of both ends of the dog toward the strap entry face.

Referring in particular to FIGS. 7 and 8, finger 58 also includes a generally planar surface 62 for initially engaging the rung 32 to be held upon retrograde movement of the strap. To ensure initial contact of the rung to be held with surface 62, the head includes a pair of spaced transverse rails 64 extending into aperture 38 and straddling locking dog 50 for limiting movement of the strap 24 toward the dog. Engagement surfce 62 and the direction of strap withdrawal force have an angular relationship so that upon application of strap withdrawal force, the dog 50 pivots toward strap entry face 34. More specifically and with reference to the force diagram shown in FIG. 8, angle *a* is the angle of intersection of surface 62 with a plane L normal to the direction of strap withdrawal force F. Angle *b* is the angle of intersection of the direction of withdrawal force F with a line connecting pivot point P and the initial point of contact C of the rung with surface 62. Where angle *a* is less than angle *b*, force F can be divided into a component F-1 normal to surface 62 and a component F-2 parallel to surface 62. As long as component F-2 is sufficient to overcome the frictional forces developed by the rung bearing against surface 62, dog 50 will be constrained to deflect toward the strap entry face 34.

Free end portion 51 of dog 50 includes positioning means for holding the rung 32 to be held. More particularly, the positioning means comprises a saddle surface 66 facing strap exit face 36 and adjoining initial engagement surface 62 of the finger 58 for cradling the held rung when the finger abuts the head. It should be noted that the distal end of the finger is preferably flattened to make full surface engagement with abutment surface 46.

Operation of cable tie 22 is as follows: After strap 24 has been positioned about the objects to be bundled, tail 42 is inserted into aperture 38. As the tie is tightened about the objects, rungs 32 sequentially interfere with and deflect locking dog 50 to its position shown in FIG. 7. Of course, after each rung passes, the dog is resiliently biased by flexible neck 52 to return toward its position shown in FIG. 6. After the strap has been tightened to the desired tension and the leading end of the strap has been released, the resiliency of the strap and the bundled objects causes application of withdrawal forces to the strap. As the strap starts its retrograde movement, the rung 32 to be held initially engages surface 62 shown in FIG. 8, thereby causing the dog to pivot toward the strap entry face. As retrograde movement of the strap continues, the engaged rung is transferred from engagement surface 62 to saddle surface 66 and finger 58 engages abutment surface 46 to limit pivotal movement of the dog 50 toward strap entry face 34. Referring to the force diagram shown in FIG. 9, with the engaged rung 32 held adjacent the free end of the dog and with abutment surface 46 applying an equal and opposite force F-1 to the force applied by finger 58 pushing on surface 46, the major component F-2 of strap withdrawal force F is directed through the locking dog from free end portion 51 through neck 52 thereby predominantly placing dog 50 in columnar loading.

Referring to FIG. 12, a prior art cable tie 22A is shown. Components of the prior art cable tie generally corresponding to components of cable tie 22 are designated by the suffix "A". Cable tie 22A has a ladder-type strap 24A with rungs 32A engageable with locking dog 50A which in turn is engageable with a ledge 70 on head 26A. Upon application of strap withdrawal force F, force component F-1, which in normal the longitudinal direction of the dog, is the major component of force F and the dog 50A is therefore predominantly loaded as a beam. With the prior art arrangement, the strap withdrawal force F is distributed between ledge 70 and the neck 52A of the dog. Accordingly, the neck must be sufficiently thick to resist shear and excessive bending. Of course, as neck thickness increases, higher threading forces are required to deflect the finger out of the strap pass path during threading of the strap into head 26A.

Figure 9:
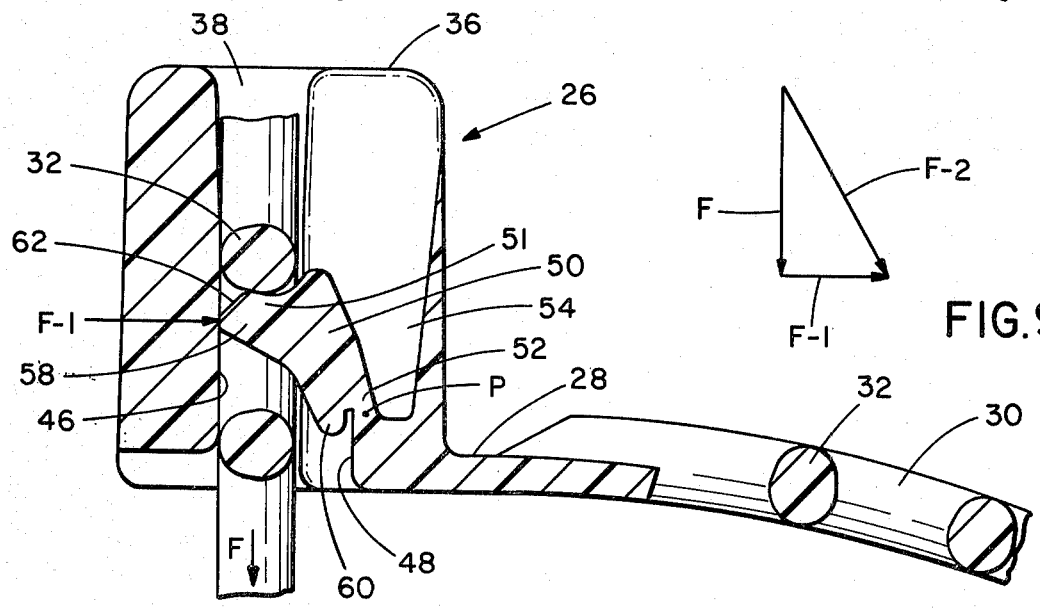
FIG. 9, similar to FIG. 7, illustrates the locking dog engaging an abutment surface of the head when the strap is under moderate withdrawal forces.

Referring to FIG. 9, with the strap under moderate withdrawal forces, only finger 62 engages its respective abutment surface while nose 60 is spaced from abutment surface 48. However, as shown in FIGS. 10 and 11, when the strap is under large withdrawal force, neck 52 deflects slightly toward transitional portion 28 and both finger 58 and nose 60 engage their respective abutment surfaces thereby firmly wedging the locking dog 50 in the head 26 and preventing further retrograde movement of the strap. The force distribution for a large withdrawal force condition is similar to that previously described regarding FIG. 9 except with nose 60 engaging abutment surface 48, nose 60 acts to relieve neck 52 of a substantial portion of the column loading and, in effect, substantially increases the cross section of the "neck portion" of the dog. With such columnar loading, shear forces at neck 52 are lessened compared to loading the locking dog primarily as a beam. This allows a reduction of the thickness of neck 52 which in turn permits the neck greater flexibility and, accordingly, decreases the threading force required in threading the strap through the head 26.

Figure 13:
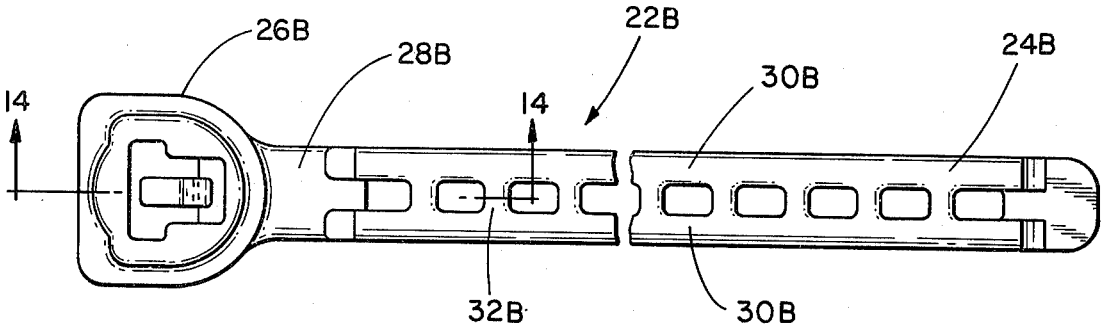
FIG. 13 is a plan of an alternate embodiment of the cable tie of the present invention which is molded to its final dimensions.
Figure 14:
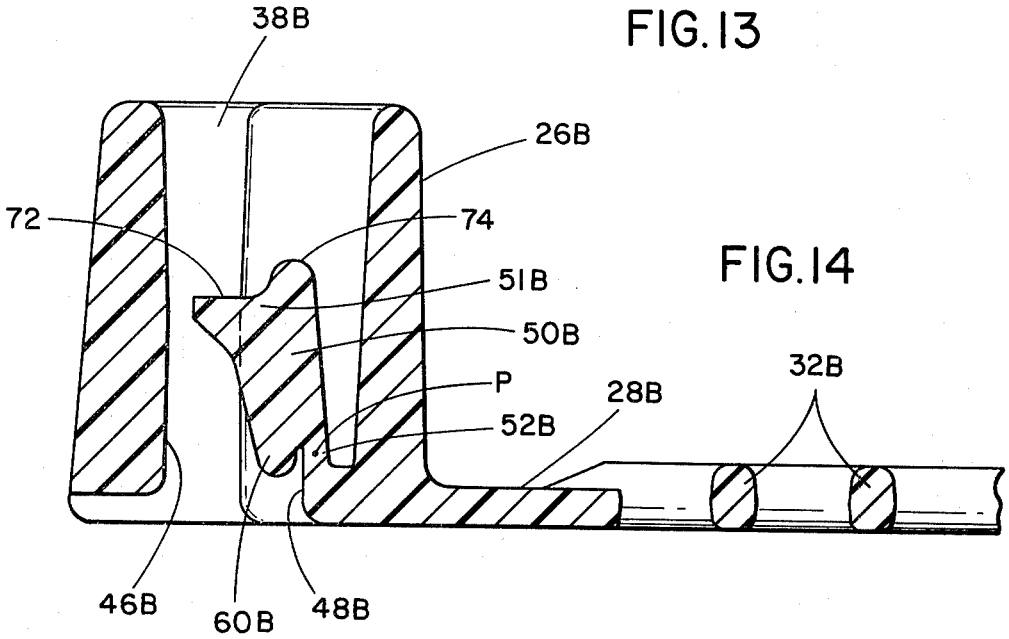
FIG. 14 is a sectional view taken generally along line 14—14 of FIG. 13.
Figure 15:
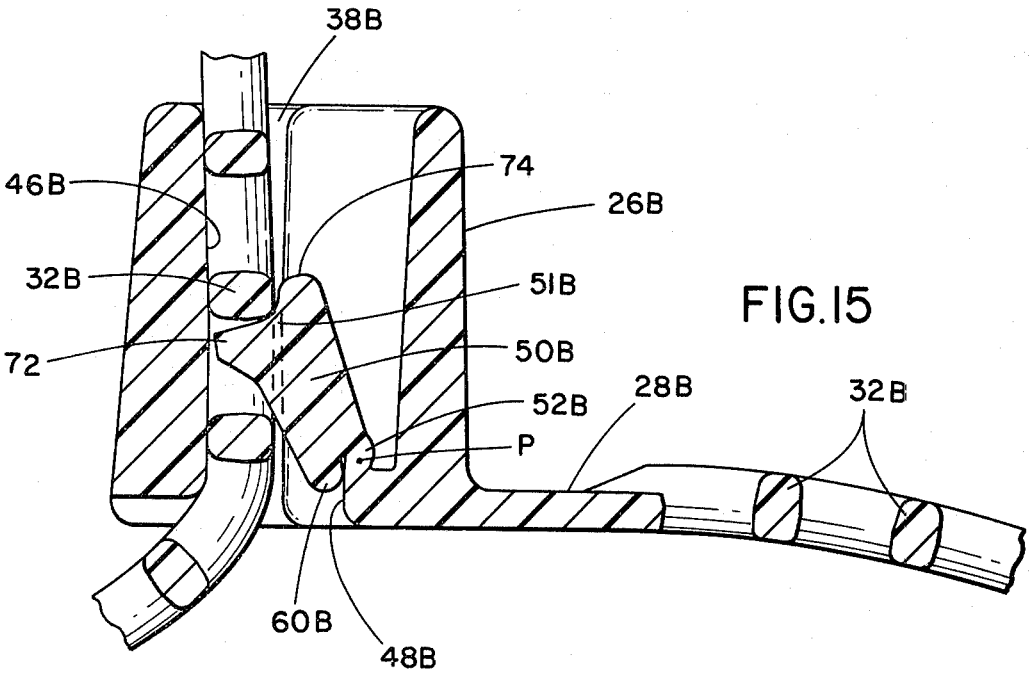
FIG. 15, similar to FIG. 14, illustrates the locking dog of the alternate embodiment of the cable tie engaging a rung of the strap and deflected to its locking position under large strap withdrawal forces.

Referring to FIG. 13, an alternate embodiment of the cable tie of the present invention is generally indicated by reference numeral 22B. Components of cable tie 22B generally corresponding to components of cable tie 22 are designated by the suffix "B". Cable tie 22B is similar to cable tie 22 except the FIG. 13 cable tie is molded to its final dimensions as opposed to being stretched from a molded part. As shown in FIGS. 14 and 15, the locking dog 50B differs from dog 50 in that dog 50B comprises a free end portion 51B including a ledge 72 for initially engaging the rung 32B to be held upon retrograde movement of strap 30B through aperture 38B. Free end portion 51B further includes a protuberant stop 74 disposed adjacent ledge 72 for abutting rung 32B as the dog pivots toward strap entrance face 34B. Ledge 72 and stop 74 constitute positioning means for holding the rung 32B.

Rungs 32B are preferably generally rectangular in cross section having generally planar sides. Generally rectangular rungs have an advantage over generally circular rungs in that if after threading and upon initial retrograde movement of the strap the dog has not fully returned to its biased position, the curved side of the circular rung might engage the dog at such an angle that the dog would be deflected out of the strap pass path instead of pivoting to hold the rung. With a rung having generally flattened sides and with the side of the rung to be engaged generally perpendicular to the direction of the strap withdrawal force, even if the dog had not fully returned to its biased position the dog would pivot toward the strap entrance face of the head.

Cable tie 22B also comprises means for limiting pivotal movement of dog 50B toward strap entrance face 34B after application of strap withdrawal force. The limiting means includes abutment surfaces 46B and 48B which partially define aperture 38B and further includes nose 60B which is engageable with surface 48B.

In operation, after the application of moderate strap withdrawal force, rung 32B is held at the free end portion of dog 50B between abutment surface 46B and stop 74 with the major component of the strap withdrawal force directed through dog 50B from free end portion 51B through neck 52B thereby predominantly placing the dog in columnar loading. As in the previous embodiment and as shown in FIG. 15, when a large withdrawal force is applied neck 52B deflects slightly toward transitional portion 28B and nose 60B engages abutment surface 48B to relieve neck 52B of a substantial portion of its load.

In view of the above, it will be seen that the several objects of the invention are achieved and other advantageous results attained.

As various changes could be made in the above constructions without departing from the scope of the invention, it is intended that all matter contained in the above description shall be interpreted as illustrative and not in a limiting sense.

What is claimed is:

1. A self-locking cable tie for forming a plurality of elongate objects such as wires into a bundle comprising:

an elongate strap including a pair of spaced longitudinally extending side rails joined by a plurality of spaced transverse rungs;

a head extending from adjacent one end of said strap and including a strap entry face, a strap exit face and a strap-receiving aperture extending between said faces;

a locking dog for holding said strap formed of a material having greater strength in compressive loading than in shear loading per unit cross-sectional area and sequentially engageable with said rungs, said dog including a flexible neck pivotally joining said dog to said head and resiliently biasing said dog to extend between adjacent rungs of said strap, said dog further including a free end portion comprising positioning means which comprises a saddle surface in spaced facing relationship with said strap exit face for cradling the rung to be held; and limiting means for limiting pivotal movement of said dog towards said strap entry face after application of a strap withdrawal force so that the major component of said force is directed through said dog from said free end portion to said neck whereby after application of the strap withdrawal force, said dog securely holds said strap and the dog is predominantly in columnar loading.

2. A cable tie as set forth in claim 1 wherein said dog further comprises a generally planar engagement surface for initially engaging the rung to be held upon application of strap withdrawal force, said engagement surface and the direction of said strap withdrawal force having an angular relationship so that upon application of said force, said dog pivots toward said strap entry face.

3. A cable tie as set forth in claim 2 wherein said engagement surface adjoins said saddle surface with the latter surface closer the pivot point of said neck whereby said engagement surface is responsive to the application of significant strap withdrawal force to transfer the engaged rung to said saddle surface.

4. A self-locking cable tie for forming a plurality of elongate objects such as wires into a bundle comprising:

an elongate strap including a pair of spaced longitudinally extending side rails joined by a plurality of spaced transverse rungs;

a head extending from adjacent one end of said strap and including a strap entry face, a strap exit face and a strap-receiving aperture extending between said faces;

a locking dog for holding said strap formed of a material having greater strength in compressive loading than in shear loading per unit cross-sectional area and sequentially engagable with said rungs, said dog including a flexible neck pivotally joining said dog to said head and resiliently biasing said dog to extend between adjacent rungs of said strap, said dog further including a free end portion comprising positioning means for holding the rung to be held; and limiting means for limiting pivotal movement of said dog towards said strap entry face after application of a strap withdrawal force so that the major component of said force is directed through said dog from said free end portion to said neck, said limiting means comprising a first abutment surface partially defining said aperture and a first abutment means carried by said dog and engageable with said surface between the pivot point of said neck and said strap exit surface whereby after application of the strap withdrawal force, said dog securely holds said strap and the dog is predominantly in columnar loading.

5. A cable tie as set forth in claim 4 wherein said limting means includes a second abutment surface partially defining said aperture and facing said first abutment surface, said dog extending from adjacent said second abutment surface.

6. A cable tie as set forth in claim 5 wherein said limting means further includes a second abutment means extending from said dog for engaging said second abutment surface between said pivot point and said strap entrance face.

7. A cable tie as set forth in claim 6 in which said dog has a first position wherein the respective abutment means are spaced from their respective abutment surfaces, a second position wherein said first abutment means engages said first abutment surface and the second abutment means is spaced from the second abutment surface, and a third position wherein the respective abutment means engage their respective abutment surfaces.

8. A cable tie as set forth in claim 4 wherein said strap is of a thermoplastic material comprising stretch-oriented molecules.

9. A cable tie as set forth in claim 4 wherein said positioning means comprises a ledge for initially engaging the rung to be held upon retrograde movement of said strap and further comprises a protuberant stop adjacent said ledge for abutting said rung.

10. A cable tie as set forth in claim 9 wherein said limiting means comprises an abutment surface partially defining said aperture, said abutment surface and said stop holding the rung to be held therebetween after application of strap withdrawal force.

11. A cable tie as set forth in claim 4 wherein the rung to be held includes a generally flat surface for initially engaging said dog upon retrograde movement of said strap.

12. A self-locking cable tie for forming a plurality of elongate objects into a bundle and comprising:

an elongate strap including a pair of spaced longitudinally extending side rails joined by spaced transverse rungs;

a head extending from adjacent one end of said strap and including a strap entry face, a strap exit face and a pair of spaced transverse surfaces partially defining a strap-receiving aperture extending between said faces; and a locking dog pivotally carried by said head adjacent one of said surfaces and extending into said aperture and resiliently biased to extend between adjacent rungs of said strap, said locking dog including first abutment means engageable with said one of said surfaces between the pivot point of said dog and said strap entry face and further including second abutment means engagable with the other of said surfaces between said pivot point and said strap exit face, said dog having a position wherein said respective abutment means engage said respective surfaces whereby after threading of said strap into the aperture of said head, said locking dog is responsive to the application of withdrawal forces to said strap to pivot about said pivot point until said respective abutment means engage said respective surfaces thereby wedging the dog between said surfaces and preventing further retrograde movement of said strap relative to said head.

* * * * *

UNITED STATES PATENT AND TRADEMARK OFFICE

CERTIFICATE OF CORRECTION

PATENT NO. : 4,003,106

DATED : January 18, 1977

INVENTOR(S) : Charles G. Schumacher et al.

It is certified that error appears in the above-identified patent and that said Letters Patent are hereby corrected as shown below:

Inventor: "Robert E. Dravec" should be --Robert E. Oravec--

Column 4, line 14-16: "For such a material, the yield stress in tension. Reference may be made to pages stress in tension. References may be maade made pages" should be --For such a material, the yield stress in compression is at least as great as the yield stress in tension. Reference may be made to pages--;

Column 8, line 32: "limting" should be --limiting--.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*